United States Patent [19]

Aumercier

[11] Patent Number: 4,945,679

[45] Date of Patent: Aug. 7, 1990

[54] DRIVING DEVICE FOR THE OUTWARD PIVOTING FRAME OF DOORS OR WINDOWS

[75] Inventor: Laurent Aumercier, Phalsbourg, France

[73] Assignee: Ferco International, Sarresbourg, France

[21] Appl. No.: 164,951

[22] Filed: Mar. 7, 1988

[30] Foreign Application Priority Data

Mar. 12, 1987 [FR] France ..... 8703597

[51] Int. Cl.[5] ..... E05F 11/24

[52] U.S. Cl. ..... 49/342; 49/341; 49/252

[58] Field of Search ..... 49/342, 341, 248, 250, 49/252, 343

[56] References Cited

U.S. PATENT DOCUMENTS

| | | | |
|---|---|---|---|
| 1,681,798 | 8/1928 | Carrier | 49/252 |
| 3,032,330 | 5/1962 | Stavenau | 49/342 |
| 4,241,541 | 12/1980 | Van Klompenburg | 49/342 |
| 4,266,371 | 5/1981 | Erdman | 49/342 |
| 4,305,228 | 12/1981 | Nelson | 49/252 |

*Primary Examiner*—Kenneth J. Dorner
*Assistant Examiner*—Gerald A. Anderson
*Attorney, Agent, or Firm*—Sandler, Greenblum & Bernstein

[57] ABSTRACT

An opening and closing device for outwardly pivoting frame closures, such as windows includes an operating handle, such as a crank or the like, which is connected to the pivoting frame drive mechanism fitted in the groove of the lower edge of the fixed frame. This drive mechanism includes a translation mechanism driven by the operating handle and actuating the rotation mechanism of the pivoting frame. The mechanism for rotation cooperates with a secondary translation element connected either directly or through a secondary arm to the pivoting frame in order to displace the latter's rotation axis in a plane parallel to that of the fixed frame.

8 Claims, 5 Drawing Sheets

DRIVING DEVICE FOR THE OUTWARD PIVOTING FRAME OF DOORS OR WINDOWS

BACKGROUND OF THE INVENTION

1. Field of the Invention

This invention relates to a driving device for outwardly pivoting frames of doors or windows which includes an operating handle such as a crank or the like fitted on a fixed frame and connected to a pivoting frame drive mechanism. This invention is more particularly useful for doors or windows opening "in the English way".

2. Description of the Prior Art

Outwardly opening closures, such as doors or windows, are frequently used, especially in countries where the climate is particularly damp during certain periods of the year. This humidity encourages the development of flying insects and, very often, the doors and windows are lined with screens, or mosquito nets, on the inside of the doors or windows. In most cases, these screens include a curtain of which the distance between the threads which make up the weft is determined in such a way as to ensure perfect circulation of air and also to stop the flying insects from passing through the screen. These screens are usually detachable and can be taken down during the winter. The screens usually consist of a frame which preferably fits into a fixed frame. Therefore, it is not possible to reach the pivoting frame of the window, since the screen is located between a user standing inside the room and the pivoting frame, which is outside the room.

This type of outwardly opening door or window has a further disadvantage of making the cleaning of the outside face of the glass surface very difficult. That is, when the window is located at a certain height from the ground, access is difficult and special means need to be provided for cleaning from the inside.

A device is known which causes a rotational movement of the pivoting frame about a vertical axis passing through one of the uprights and a displacement of the rotation axis in a plane parallel to that of the fixed frame about a vertical axis passing through one of the uprights and a displacement of the rotation axis in a plane parallel to that of the fixed frame. The combination of these two movements results in a displacement to the side by the pivoting frame with respect to the fixed frame and in the creation of a free space on the rotation side, which gives access to the outside face of the glass surface.

This device includes a crank fitted on a lower cross member of the fixed frame. The crank is connected to a worm screw with an axis inclined at approximately thirty degrees with respect to the horizontal in such a way that the window sill does not hinder the rotation of the operating crank. The worm screw engages a pinion with inclined gearing mounted in free rotation on a vertical shaft. A pivoting driving arm is also mounted on the vertical shaft and includes at its end a roller moving in a rail disposed horizontally in a lower part of the pivoting frame. The pinion driven by the worm screw engages a second pinion which rotates freely about a shaft that is integral with the driving arm. On this second pinion is fastened a second arm linked by a connecting rod to the back end of the pivoting frame.

In this way, when the worm screw is rotated by the crank, the cooperation of the two pinions results, on the one hand, in a rotational movement of the driving arm about its axis, and on the other hand, in a combination of two rotational movements of the second arm. This combination consists of a first rotation of the second pinion shaft about the axis of the pinion driven by the worm screw and a second rotation of the bent arm about the axis of the second pinion. These simultaneous movements of the driving arm and the second arm result in a rotational movement of the pivoting frame about the vertical axis passing through one of its uprights and movement of the rotational axis of the pivoting frame in a plane parallel to that of the fixed frames. This device also includes a compass connecting the pivoting frame to the fixed frame and whose function consists mainly in the distribution of the forces applied by the crank onto the driving arm and the second arm, in order to assist the rotation and the simultaneous movement of the pivoting frame.

It is noted that this device, includes certain disadvantages which are mainly in the complexity of the opening and closing mechanism of the pivoting frame, which makes this device rather unreliable. Moreover, certain components of this driving device for pivoting frames are particularly difficult to make, which increases the cost considerably. This is the case, in particular for the pinions, whose gearing must be inclined since they are intended to engage the worm screw, the axis of which forms an angle of thirty degrees with the horizontal for mechanical and convenience reasons.

SUMMARY OF THE INVENTION

The object of the present invention is to eliminate all the disadvantages mentioned above while keeping the advantages of a device which includes a side movement of the rotational axis of the pivoting frame during the opening of the pivoting frame, in order to give access to the external face of the glass surface of the closure.

The invention includes an opening and closing device for the outwardly pivoting frame of doors or windows having an operating handle such as a crank or the like disposed on the fixed frame and connected to a driving mechanism fitted with means of rotation of the pivoting frame driven by translation means, namely, a rack actuated by a driving pinion controlled by the operating handle.

Another object of the invention includes a driving device of the outwardly pivoting frame of doors or windows having means for rotation of the pivoting frame co-operating with second means for translation connected through a secondary arm to the pivoting frame, in order to simultaneously move the latter towards the exterior of the fixed frame and to laterally move the pivoting axis of the pivoting frame in a plane parallel to that of the fixed frame.

The advantages obtained from this invention lie mainly in that the components of the driving device are of reduced complexity, which improves their reliability. Another disadvantage lies in the deletion of pinions with inclined gearing, which considerably eases the manufacture of the different components.

It is noted that the different moving parts of the driving device according to the invention work in the same manner as transmission differentials, which improves the distribution of the forces applied to them and facilitates the operation of the pivoting frame.

BRIEF DESCRIPTION OF THE DRAWINGS

Other objectives and advantages of the present invention will be further explained the following description with reference to drawings illustrating, by way of non-limiting examples, embodiments of the invention wherein.

DESCRIPTION OF THE PREFERRED EMBODIMENTS

Figure 1:
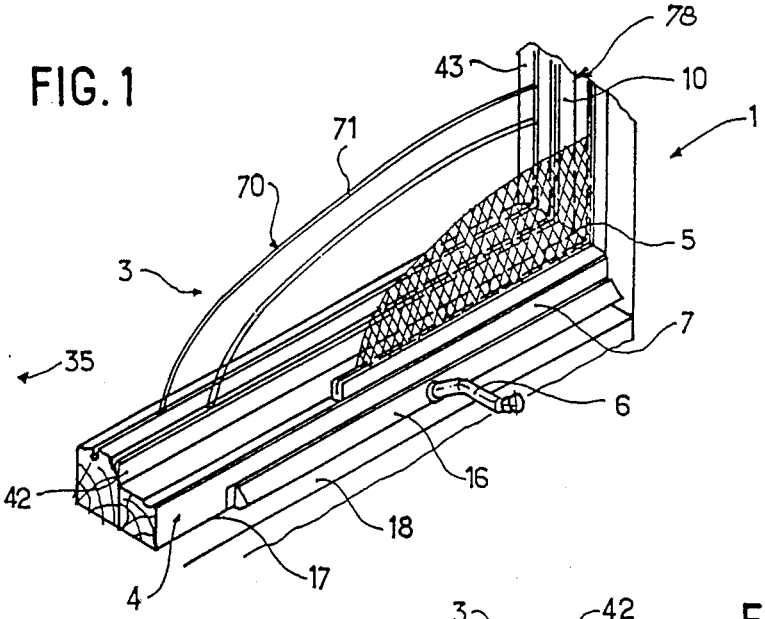
FIG. 1 is a partial perspective view of a window with a driving device according to the invention.
Figure 2:
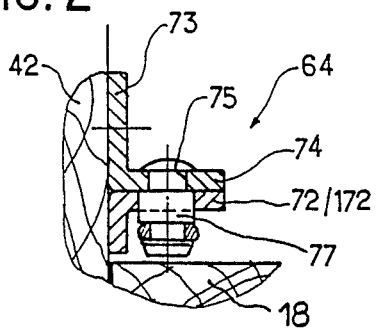
FIG. 2 is a detailed cross-sectional view of the joint connecting the driving device to the back part of the pivoting frame.
Figure 3:
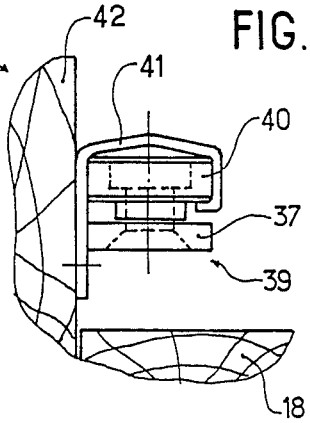
FIG. 3 is a detailed cross-sectional view of the connection between the driving arm and the pivoting frames.
Figure 4:
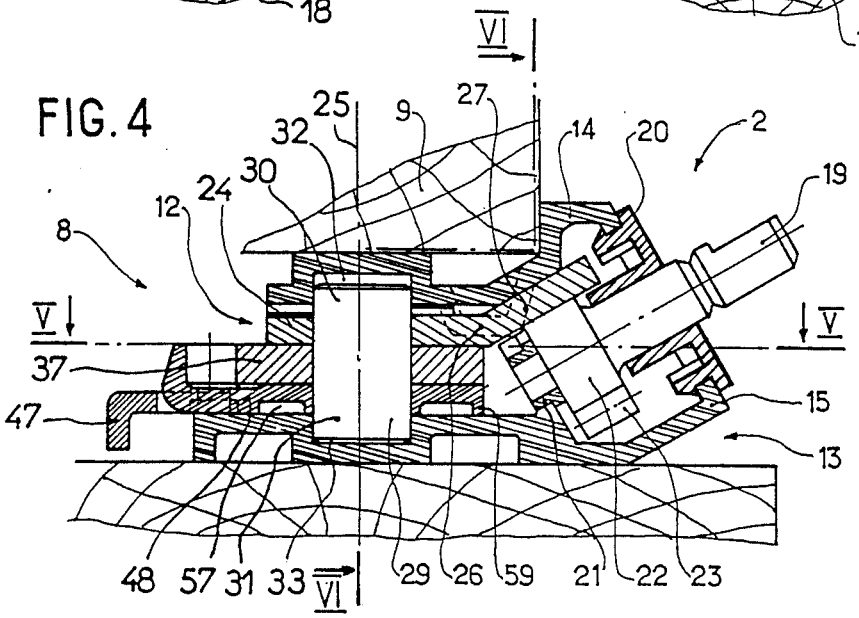
FIG. 4 is an elevation cross-sectional view according to IV—IV of FIG. 5 of the driving device according to a first embodiment.
Figure 5:
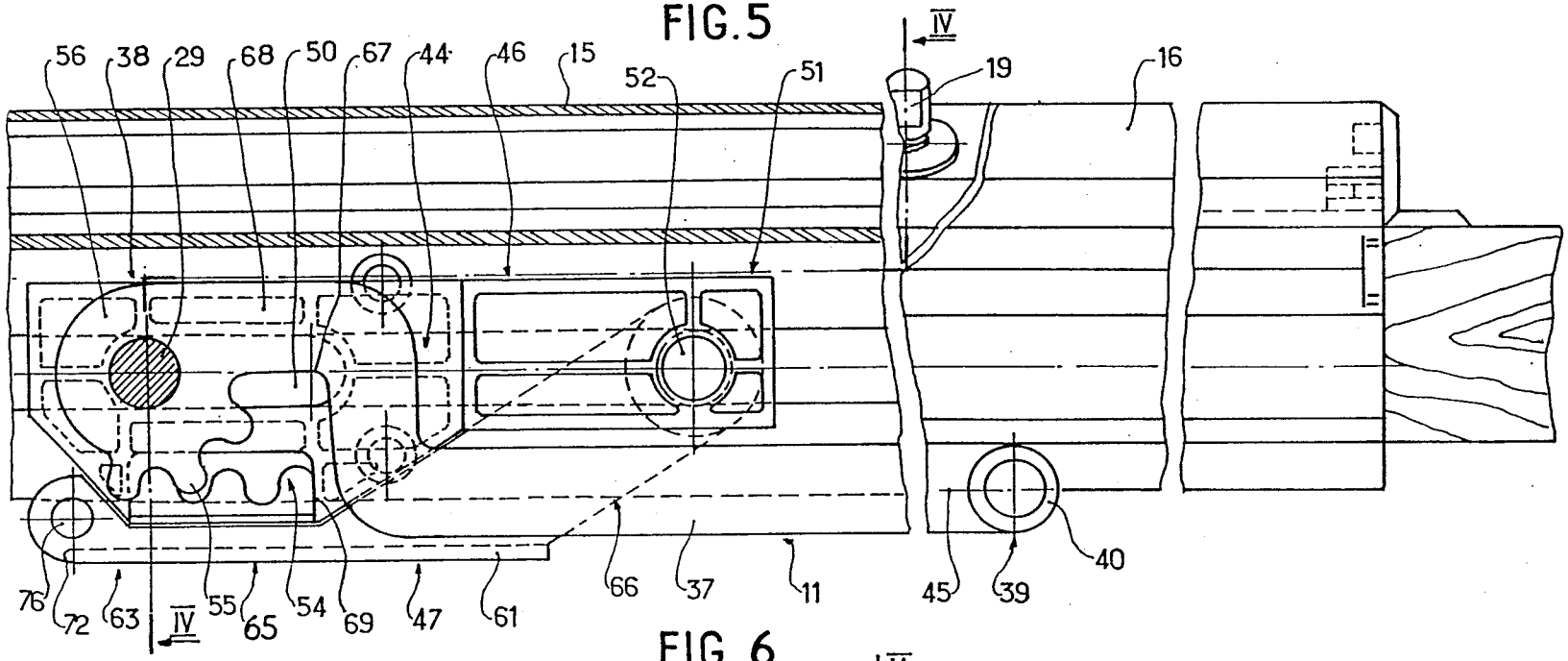
FIG. 5 is a partial cross-sectional plan view according to V—V of FIG. 4.
Figure 6:
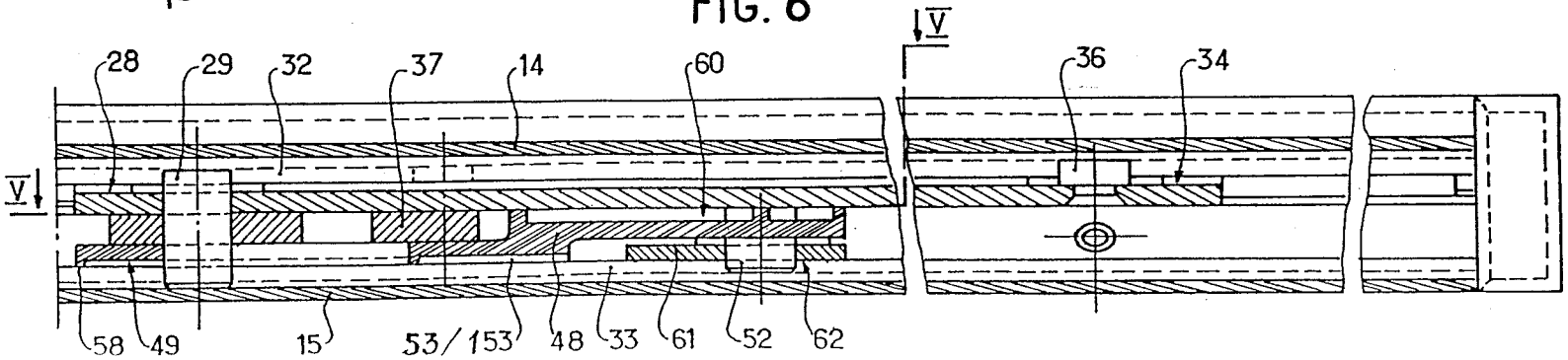
FIG. 6 is an elevation cross-sectional view according to VI—VI of FIG. 4.
Figure 7:
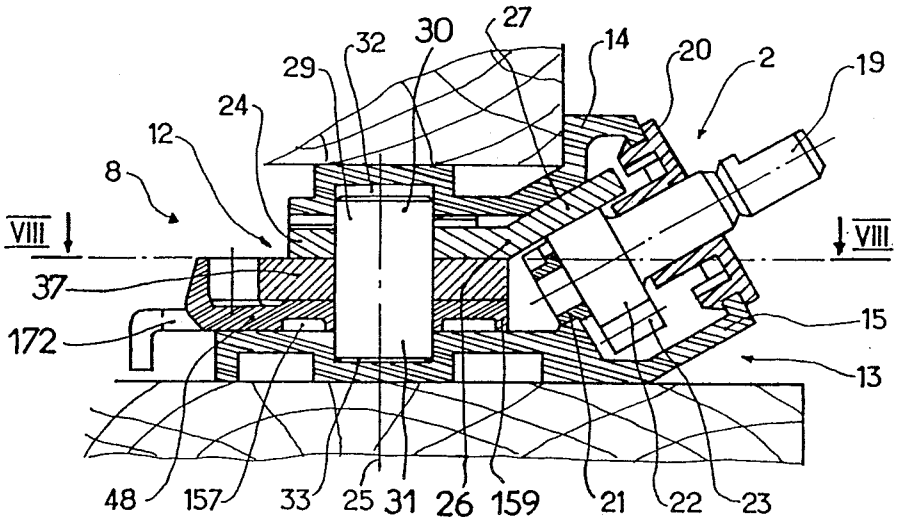
FIG. 7 is an elevation cross-sectional view according to VII—VII of FIG. 8 showing a second embodiment of the driving device according to the invention.
Figure 8:
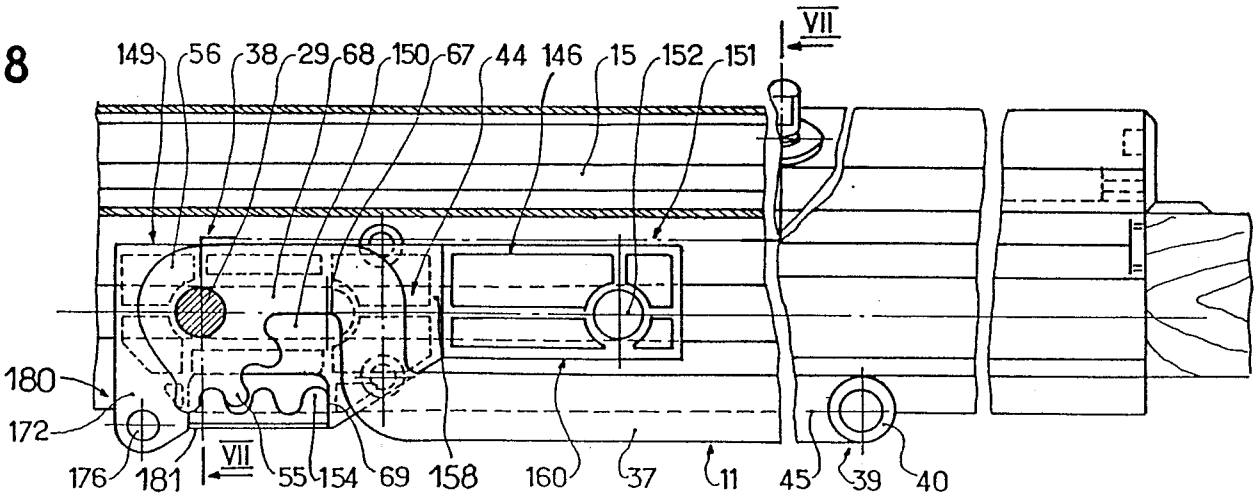
FIG. 8 is a plan partial cross-sectional view according to VII—VII of FIG. 7.
Figure 9:
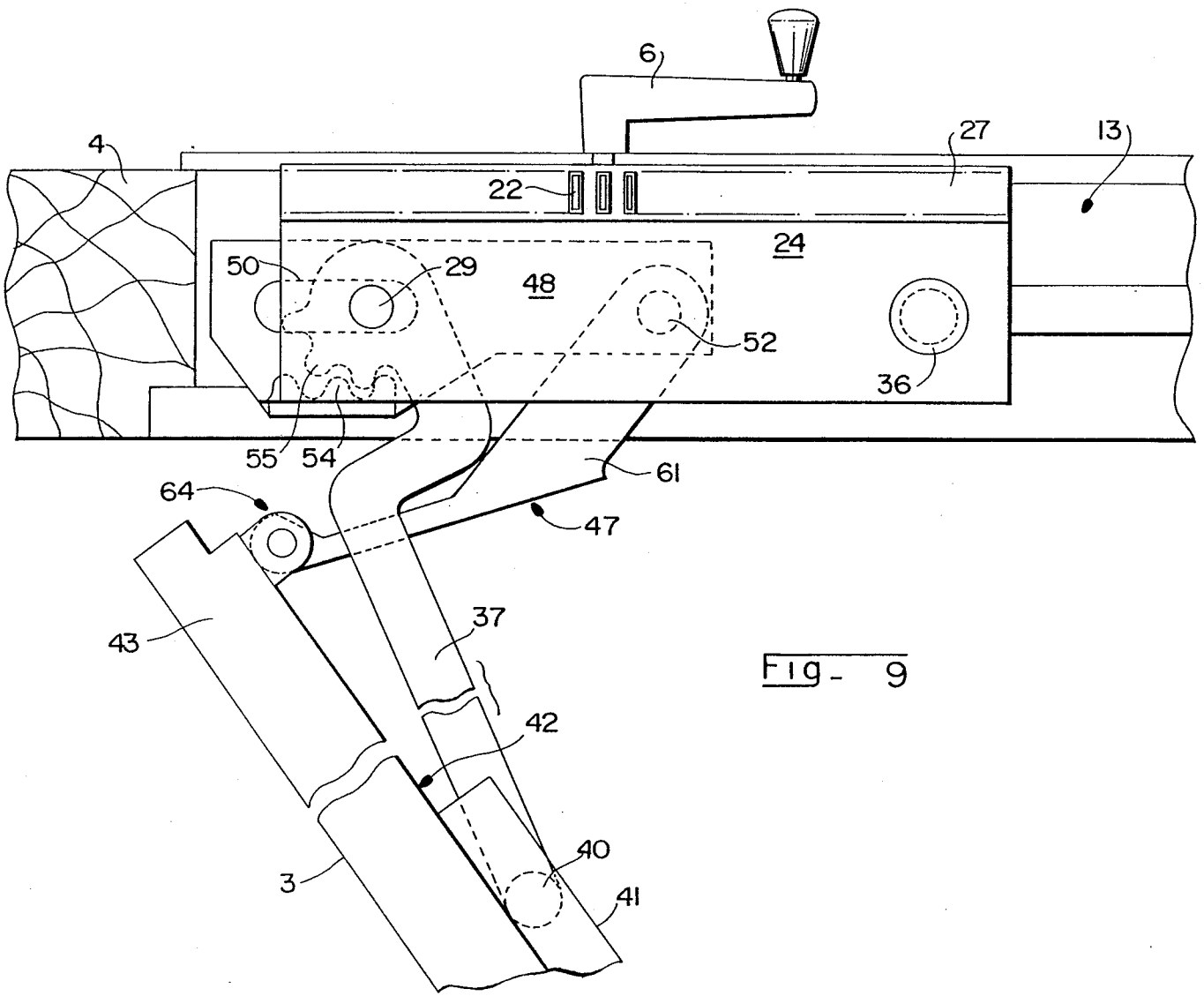
FIG. 9 is a plan view similar to FIG. 5 showing the pivoting frame in an open position.
Figure 10:
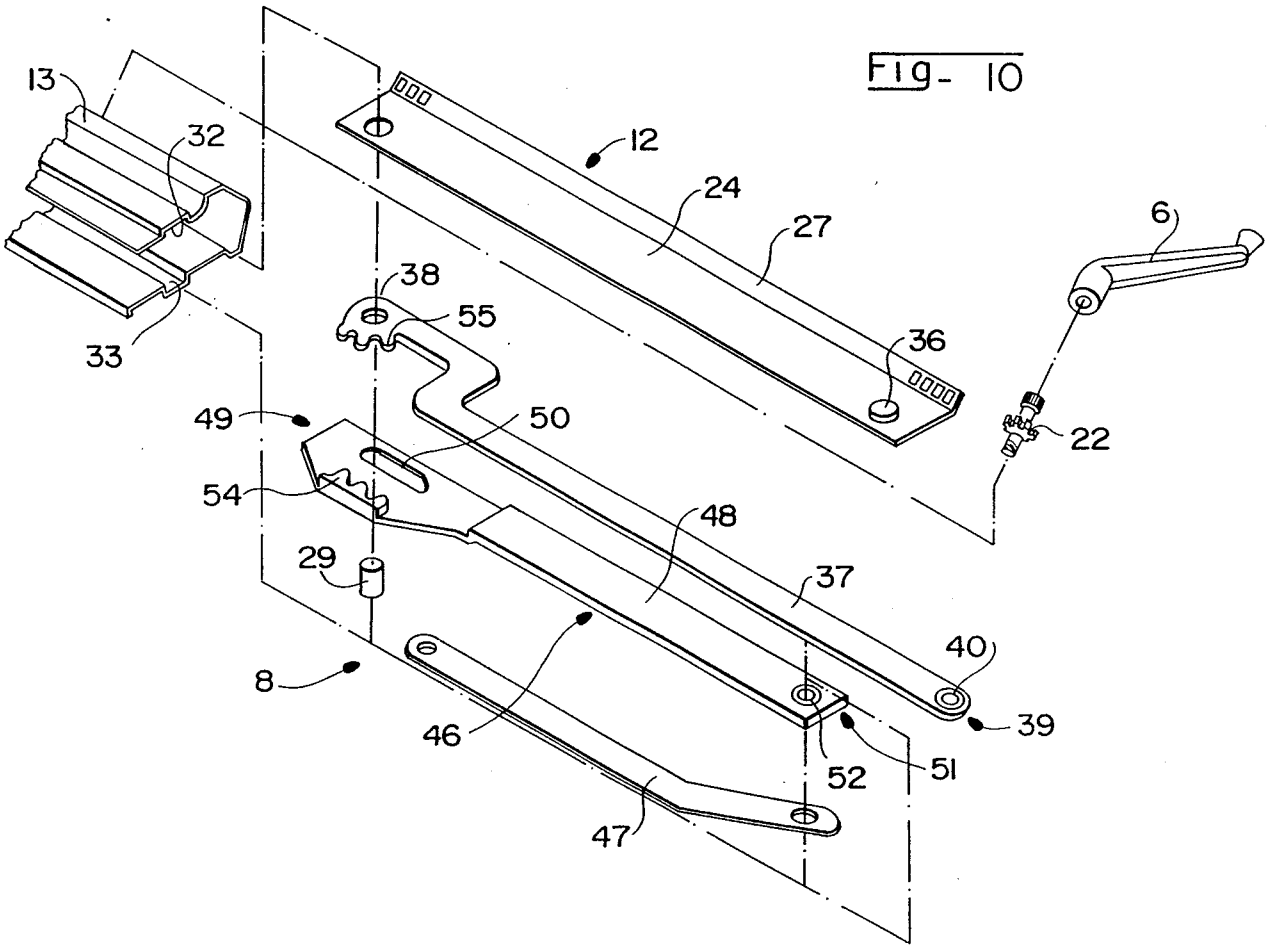
FIG. 10 is an exploded view of the driving device.

Reference is initially made to FIGS. 1 to 6, 9, and 10. Closure 1 controlled by driving device 2 according to the invention includes a pivoting frame 3 resting on the exterior of fixed frame 4. In this way, pivoting frame 3 can open only through outward pivoting. FIG. 1 shows window 1 including a screen 5 integral with fixed frame 4 and disposed internally of pivoting frame 3.

The purpose of driving device 2 is to open and close pivoting frame 3 from inside the window 1 without removing screen 5. Driving device 2 includes an operating handle 6 represented by a crank in FIG. 1. Operating handle 6 is disposed on fixed frame 4, approximately in the median part of lower edge 7 of fixed frame 4. It is connected to mechanism 8 fitted in groove 9 of lower edge 7 or, when there is no screen, in an appropriate fillister of pivoting frame 3. Mechanism 8 enables operation of the pivoting frame 3 and serves, on the one hand, to ensure the pivoting movement of frame 3 towards the exterior about a vertical rotation axis passing through back upright 10, and on the other hand, to displace the rotation axis of pivoting frame 3 laterally in a plane parallel to that of fixed frame 4.

To achieve this, mechanism 8 of driving device 2, according to one of the characteristics of the invention, includes means for rotation 11 of pivoting frame 3 driven by means for translation 12 actuated by operating handle 6.

Mechanism 8 comprises rotation means 11 and translation means 12 and is arranged in casing 13 inserted into groove 9 of lower edge 7 of fixed frame 4. Casing 13 includes cover 14 and base plate 15 and includes a longitudinal edge 16 on the inner side of window 1, in lower angle 17 formed by fixed frame 4 and window sill 18. The median part of longitudinal edge 16 of casing 13 contains operating handle 6. The handle rotates integrally with free turning shaft 18 which is held by bearings 20, 21 inside casing 13. Shaft 19 lies in a plane perpendicular to that of fixed frame 4 and forms an angle of approximately thirty degrees with the horizontal, in such a way that window sill 18 does not hinder the rotation of operating handle 6.

Shaft 19 is fitted with drive pinion 22 with radial flank teeth 23 which engage translation means 12. Translation means 12 includes rectangular shape fitted in casing 13, the longitudinal median plane 25 of rack 24 being parallel to the plan of fixed frame 4. Rack 24 includes, on longitudinal edge 26 wing 27 forming an angle of approximately thirty degrees with the horizontal plane and including a toothed sector cooperating with the gearing 23 of drive pinion 22. This cooperation of drive pinion 22 and rack 24 makes it possible to displace the rack longitudinally in a plane parallel to that of fixed frame 4. In order to guide the displacement of rack 24, the rack is provided near its end 28 with a vertical pin 29 towards back upright 10 of pivoting frame 3 and located in longitudinal median plane 25 and whose ends 30, 31 cooperate with groves 32, 33 which are machined, respectively, in cover 14 and in base plate 15 of casing 13. The centerline of grooves 32, 33 is horizontally arranged in longitudinal median plane 25 of rack 24. The rack is also guided in its longitudinal displacement by a roller 36, at its end 34 pointing towards upright 35 of the pivoting frame 3, a cooperating with grove 32 provided in cover 14 of casing 13.

The means for rotation 11 of pivoting frame 3 are mounted onto rack 24. They consist of driving arm 37 whose end rotates about vertical pin 29. The other end 39 of arm 37 is fitted with roller 40 which moves in guiding rail 41 disposed horizontally on lower cross member 42 of framework 43 of pivoting frame 3. Driving arm 37 includes near end 38 configuration 44 in the shape of an "S", which allows for the side displacement of the rotation axis of driving arm 37 with respect to its centerline 45. Driving arm 37 is advantageously mounted beneath rack 24.

According to a first embodiment, mechanism 8 is also intended to cause a displacement of the rotation axis of pivoting frame 3 perpendicular to the plane of fixed frame 4, so as to release pivoting frame 3 from fixed frame 4.

To achieve this, rotation means 11 including driving arm 37 cooperates with second translation means 46 which is connected to pivoting frame 3 by secondary arm 47. This makes it possible to simultaneously obtain a displacement of framework 43 of pivoting frame 3 towards the exterior of fixed frame 4 and a translational movement of the rotation axis of pivoting frame 3 parallel to the plane of fixed frame 4.

This arrangement prevents any deterioration of the water-proof sealing of the groove in fixed frame 4 or in framework 43 of pivoting frame 3 by the repeated friction during displacement of the rotation axis of pivoting frame 3, particularly beginning of the opening and at the end of the closing operation of window 1.

In a preferred embodiment, second translation means 46 includes carriage 48 of approximately rectangular shape which is arranged parallel under rack 24. In order to impart a horizontal displacement to carriage 48 in the longitudinal median plane 25 of rack 24, carriage 48 includes in its back part 49 an elongated slot 50 towards back upright 10 of pivoting frame 3 and co-operating with vertical pin 29 which is integral with rack 24. It is noted that driving arm 37 is mounted onto pin 29 between carriage 48 and rack 24. Rack 48 also includes at its end 51 pin 52 protruding out of lower face 53 of carriage 48 and engaging groove 33 which is provided in base plate 15 of casing 13.

Carriage 48 is also fitted with toothed sector 54 which engages gearing 55 which is machined along rim 56 of end 38 of driving arm 37. Gearing 55 has the shape of an arc of a circle whose center coincides with the rotation axis of driving arm 37. The cooperation of gearing 55 of driving arm 37 with toothed sector 54 of the carriage imparts to the carriage a longitudinal displacement in a direction which depends on the rotational direction of driving arm 37.

In order to facilitate the simultaneous displacements of rack 24 and of carriage 48 in casing 13, the contact surfaces have to be reduced, particularly between base plate 15 of casing 13 and lower face 53 of carriage 48. To aChieve this, longitudinal recesses 57 are provided in lower face 53 of the carriage, which allows for the reduction of the transverse and longitudinal bearing surfaces 58, 59, respectively.

Since carriage 48 is arranged beneath driving arm 37 and rack 24, it also functions as a stop, particularly its front part 60 on which rack 24 rests. The rack must be maintained in an approximately horizontal position so that roller 36 which is fitted at end 34 of rack 24 can cooperate with groove 32 of cover 1 4.

According to a first embodiment, secondary arm 47 includes a connecting rod 61 whose end 62 is integral with pin 52 which is fitted at end 51 of carriage 48. The other end 63 of rod 61 is connected by an articulation 64 to pivoting frame 3 near back upright 10. Rod 61 is slightly bent in a horizontal plane, so as to form a wing 65 which lies parallel to the plane of fixed frame 4 when pivoting frame 3 is closed, and a wing 66 which extends into casing 13 and gives access to pin 52.

In this way, the opening of window 1 imparts to the operating handle 6 a counter-clockwise rotation which drives rack 24 through drive pinion 22. In turn, rack 24 drives driving arm 37 in a translational movement which, due to the interaction of gearing 55 with toothed sector 54 of carriage 48, simultaneously starts a rotation movement about vertical pin 29. Moreover, the rotation of driving arm 37 results in a longitudinal displacement of carriage 48. This displacement affects pivoting frame 3 through secondary arm 47 and articulation 64. This results in displacement of framework 43 of pivoting frame 3 towards the exterior of fixed frame 4, followed immediately by a rotational movement of pivoting frame 3 combined with a translational movement of the rotation axis of pivoting frame 3 parallel to the plane of fixed frame 4.

According to another embodiment which is not shown in the figures, the secondary arm 47 includes a slider connected to carriage 48 which moves freely in a direction perpendicular to the plane of fixed frame 4. One end of this slider is fastened to pivoting frame 3 near back upright 10. The connection between carriage 48 and slider consists of guiding rails or the like which are arranged perpendicularly to the plane of fixed frame 4 and onto carriage 48. The slider is provided with elements enabling cooperation with these guiding rails. In this embodiment, the slider has a rectangular shape and longitudinal edges which engage the guiding rails of carriage 48 and whose distance depends on the width of the slider. Moreover, the connection between the slider and pivoting frame 3 includes an connection between the slider and pivoting frame 3 includes an articulation 64 providing for the rotation of pivoting frame 3.

According to another aspect of the invention, when the window 1 is fully opened, side face 67 of section 68 connecting the end 38 to "S"-shaped portion 44 of driving arm 37 abuts against front cross side 69 of toothed sector 54 of carriage 48.

In order to facilitate access to outside face 70 of glass surface 71, articulation 64 which forms the connection between rod 61 or the slider and pivoting frame 3 is removable. For this purpose, rod 61 of the slider includes end 72 which is under square-shaped element 73 which is fitted onto pivoting frame 3 and is provided with aperture 75 in horizontally arranged wing 74. Aperture 75 of the square-shaped element and aperture 76 of end 72 are located on the same vertical axis and define a passageway for removable fastening element 77. It is essential that fastening element ensures the positioning in the horizontal plane of rod 61 or the slider with respect to pivoting frame 3. The vertical positioning is ensured by the location of square-shaped element 73 on pivoting frame 3 and by its cooperation with fastening element 77.

According to another embodiment with reference to FIGS. 1, 2, 3, 7 and 8, rotation means 11 including driving arm 37 co-operates with second means for translation 146 which is connected directly to pivoting frame 3.

This arrangement considerably simplifies mechanism 8 while ensuring both the rotation of pivoting frame 3 and the translation of its rotation axis in a plane parallel to that of fixed frame 4.

Second translation means 146 advantageously consists of carriage 148 with an approximately rectangular shape arranged parallel and beneath rack 24. In order to impart to carriage 148 a horizontal displacement in longitudinal median plane 25 of rack 24, carriage 148 includes in its back part 149 an elongated slot 50 positioned towards back upright 10 of pivoting frame 3 and cooperating with vertical pin 29 which is integral with rack 24. It is noted that driving arm 37 is mounted onto pin 29 between carriage 148 and rack 24. Carriage 148 also includes at its end 151 pin 152 protruding out of lower face 153 of carriage 148 and cooperating with groove 33 which is provided in base plate 15 of casing 13.

Casing 148 is also fitted with a toothed sector 154 cooperating with gearing 55 of rim 56 of the end 38 of driving arm 37. Gearing 55 forms an arc of a circle whose center coincides with the rotation axis of driving arm 37. This cooperation of gearing 55 of driving arm 37 with toothed sector 154 of carriage 148 imparts to the carriage a longitudinal displacement in a direction which depends on the direction of rotation of driving arm 37.

In order to facilitate the simultaneous displacements of rack 24 and carriage 148 in casing 13, the contact surfaces have to be reduced, particularly between base plate 15 of casing 13 and lower face 153 of carriage 148. To achieve this, longitudinal recesses 157 are provided in the lower face of the carriage in order to reduce the area of the transverse and longitudinal 159 bearing surfaces 158, 159, respectively.

Since carriage 148 is mounted beneath driving arm 37 and rack 24, the carriage also functions as a stop, particularly in its front part 160 on which rack 24 rests. The rack must be maintained in an approximately horizontal position, so that roller 36 which is fitted at the end 34 of rack 24 cooperates with groove 32 of cover 14.

The connection between carriage 148 and pivoting frame 3 is achieved by means of articulation 64, which provides for the rotation of pivoting frame 3 about a vertical axis passing through articulation 64. For this purpose, articulation 64 is located as near as possible to back side 78 of pivoting frame, in such a way that the groove of fixed frame 4 does not hinder the rotation of pivoting frame 3.

When opening window 1, the driving device 2 according to this second embodiment operates as follows:

The operation of the crank handle results, through the drive pinion 22, in a longitudinal displacement of rack 24. The rack drives driving arm 37 whose gearing 55 cooperates with toothed sector 154 of carriage 148, which rotates about vertical pin 29. This results in the rotation of pivoting frame 3 towards the exterior. Carriage 148 moves parallel to the plane of fixed frame 4, which in turn displaces the rotation axis of pivoting frame 3 in a plane parallel to that of fixed frame 4.

In fact, these combined rotational and translational movements of pivoting frame 3 simultaneously take place. The whole set of components of the driving device move in the reverse direction when closing the window.

Articulation 64 includes an eyelet 172 which is integral with carriage 148 and a square-shaped element 73 fitted onto lower cross member 42 of framework 43 of pivoting frame 3. Eyelet 172 is located at back end 180 of carriage 148 and protrudes out of external longitudinal side 181.

An aperture 75 is provided in horizontal wing 74 of square-shaped element 73, on the same vertical axis and above aperture 176 of eyelet 172, whereby apertures 75 and 176 serve as a passageway for fastening element 77. The fastening element is preferably detachable, in order to allow pivoting frame to be disengaged from carriage 148 so as to allow pivoting frame 3 to be disengaged from carriage 148 so as to allow easier access to external face 70 of glass surface 71, by the rotation of pivoting frame 3 about roller pin 40 which is integral with end 39 of driving arm 37, as the roller slides in guiding rail 41.

One advantage of the invention is to enable the reversing of the use of each of the constitutive elements of the driving mechanism in order to achieve the different results obtained and described for each of these elements in the first embodiment.

What is claimed:

1. A driving device for moving a pivoting frame with respect to a fixed frame comprising:

(a) a first translation means mounted for translational movement with respect to said fixed frame;

(b) a pinion mounted for engagement with said translation member, rotation of which effects the translational movement of said translation member, (c) means for rotating said pinion; and (d) a second translation means adapted to be connected to said pivoting frame for displacing a pivot axis of said pivoting frame in a plane substantially parallel to a plane defined by said fixed frame, wherein said first translation means comprises a rack having a wing along a longitudinal edge extending therefrom at an angle of approximately thirty degrees, said wing having a toothed segment for cooperation with teeth of said pinion, said rack being mounted in a casing having a cover and a base plate disposed substantially parallel to a plane defined by said fixed frame.

2. The driving device of claim 1, further comprising a substantially vertically extending pin fitted at an end of said rack and having ends which cooperate with grooves located in said cover, said rack further having a roller for cooperation with a groove provided in said cover.

3. A driving device for moving a pivoting frame with respect to a fixed frame comprising:

(a) a first translation means mounted for translational movement with respect to said fixed frame;

(b) a pinion mounted for engagement with said translation member, rotation of which effects said translational movement of said translation member;

(c) means for rotating said pinion; and (d) a second translation means adapted to be connected to said pivoting frame for displacing a pivot axis of said pivoting frame in a plane substantially parallel to a plane defined by said fixed frame, wherein said first translation means comprises a rack, said driving device further comprising a substantially vertically extending pin fitted at an end of said rack, said rack having a rotation means for the pivoting frame comprising a driving arm having an end mounted for pivoting around said pin and another arm having a roller mounted thereon for sliding in a guide arranged substantially horizontally on a lower portion of said pivoting frame.

4. A driving device for moving a pivoting frame with respect to a fixed frame comprising:

(a) a first translation means mounted for translational movement with respect to said fixed frame;

(b) a pinion mounted for engagement with said translation member, rotation of which effects said translational movement of said translation member;

(c) means for rotating said pinion; and (d) a second translation means adapted to be connected to said pivoting frame for displacing a pivot axis of said pivoting frame in a plane substantially parallel to a plane defined by said fixed frame, wherein said first translation means comprises a rack having a substantially vertically extending pin fitted integral with said rack, said rack being mounted in a casing having a cover, wherein said second translation means comprises a carriage mounted substantially parallel to said rack, said carriage having, at one end, an elongated slot inside of which said pin is located and, at another end, a second pin for cooperation with a groove provided in said cover.

5. The driving device according to claim 4, wherein said second translation means includes a device directly connected to said pivoting frame and comprising a carriage fitted with an eyelet extending from an external longitudinal side, said eyelet cooperating with an element positioned on a lower cross-member of said pivoting frame to form an articulation therefor.

6. A driving device for moving a pivoting frame with respect to a fixed frame comprising:

(a) a first translation means mounted for translational movement with respect to said fixed frame;

(b) a pinion mounted for engagement with said translation member, rotation of which effects said translational movement of said translation member;

(c) means for rotating said pinion; and (d) a second translation means adapted to be connected to said pivoting frame for displacing a pivot axis of said pivoting frame in a plane substantially parallel to a plane defined by said fixed frame, said driving device further comprising a driving arm having a toothed segment, wherein said second translation means comprises a carriage having a toothed segment for cooperation with said toothed segment of said driving arm for displacing said carriage longitudinally substantially in a plane defined by said fixed frame.

7. A driving device for moving a pivoting frame with respect to a fixed frame comprising:

(a) a first translation means mounted for translational movement with respect to said fixed frame;

(b) a pinion mounted for engagement with said translation member, rotation of which effects said translational movement of said translation member;

(c) a means for rotating said pinion; and (d) a second translation means adapted to be connected to said pivoting frame for displacing a pivot axis of said pivoting frame in a plane substantially parallel to a plane defined by said fixed frame, said driving device further comprising a secondary arm connecting said second translation means to said pivoting frame, said secondary arm comprising a sliding element for moving substantially perpendicularly with respect to a plane defined by said fixed frame, said second translation means further comprising guiding rails for said sliding element, said sliding element adapted to be connected to said pivoting frame through an articulation and for moving said pivoting frame toward the exterior of said fixed frame.

8. A driving device for moving a pivoting frame with respect to a fixed frame comprising:

(a) a first translation means mounted for translational movement with respect to said fixed frame;

(b) a pinion mounted for engagement with said translation member, rotation of which effects said translational movement of said translation member;

(c) means for rotating said pinion; and (d) a second translation means adapted to be connected to said pivoting frame for displacing a pivot axis of said pivoting frame in a plane substantially parallel to a plane defined by said fixed frame, said driving device further comprising a secondary arm connecting said second translation means to said pivoting frame, said secondary arm comprising a rod having an end which is pivotally mounted on said second translation means, said rod having another end connected by an articulation to said pivoting frame.

* * * * *